US008931718B2

(12) United States Patent
Grandi et al.

(10) Patent No.: US 8,931,718 B2
(45) Date of Patent: Jan. 13, 2015

(54) VALVE ASSEMBLY FOR AN INJECTION VALVE AND INJECTION VALVE

(75) Inventors: Mauro Grandi, Leghorn (IT); Valerio Polidori, Leghorn (IT); Cristiano Mannucci, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 400 days.

(21) Appl. No.: 13/524,151

(22) Filed: Jun. 15, 2012

(65) Prior Publication Data

US 2012/0318885 A1 Dec. 20, 2012

(30) Foreign Application Priority Data

Jun. 15, 2011 (EP) ..... 11169988

(51) Int. Cl.
*B05B 1/30* (2006.01)
*F02M 51/06* (2006.01)

(52) U.S. Cl.
CPC ..... *F02M 51/066* (2013.01); *F02M 51/0664* (2013.01); *F02M 2200/306* (2013.01)
USPC ..... 239/585.4; 239/585.5

(58) Field of Classification Search
CPC ..... F02M 51/0621; F02M 51/066; F02M 51/0653
USPC ..... 239/585.1, 585.3, 585.4, 585.5, 533.2, 239/533.9, 533.11, 584; 251/129.15, 251/129.21, 127
See application file for complete search history.

(56) References Cited

U.S. PATENT DOCUMENTS

| | | | | |
|---|---|---|---|---|
| 4,646,974 | A * | 3/1987 | Sofianek et al. | 239/463 |
| 5,465,910 | A * | 11/1995 | Hall et al. | 239/585.4 |
| 5,494,223 | A * | 2/1996 | Hall et al. | 239/585.5 |
| 5,544,816 | A * | 8/1996 | Nally et al. | 239/585.5 |
| 7,086,615 | B2 * | 8/2006 | Joseph | 239/596 |

FOREIGN PATENT DOCUMENTS

| | | | | |
|---|---|---|---|---|
| DE | 102004056424 | A1 | 5/2006 | F02M 51/06 |
| EP | 1460263 | A1 | 9/2004 | F02M 51/06 |
| EP | 1550804 | A1 | 7/2005 | F02M 51/06 |
| EP | 2527637 | A1 | 11/2012 | F02M 51/06 |

OTHER PUBLICATIONS

European Search Report and Written Opinion for Application No. 11169988.0-1263 (5 pages), Oct. 31, 2011.

(Continued)

*Primary Examiner* — Davis Hwu
(74) *Attorney, Agent, or Firm* — King & Spalding L.L.P.

(57) ABSTRACT

A valve assembly for an injection valve may include a valve body comprising a cavity with a fluid inlet portion and a fluid outlet, and a valve needle axially movable in the cavity, the valve needle preventing a fluid flow through the fluid outlet in a closing position and releasing the fluid flow through the fluid outlet in further positions, the valve needle comprising a radially extending protrusion and an electro-magnetic actuator unit configured to actuate the valve needle and comprising an armature in the cavity. The armature comprises an armature cavity having a first stop surface and a second stop surface that faces the first stop surface. The protrusion of the valve needle is arranged in the armature cavity axially between the first stop surface and the second stop surface such that a relative movement between the valve needle and the armature in axial direction is limited.

13 Claims, 2 Drawing Sheets

(56) References Cited

OTHER PUBLICATIONS

European Office Action, Application No. 11169988.0, 4 pages, Nov. 25, 2013.

European Search Report, Application No. 11167084.0, 5 pages, Sep. 14, 2011.

International Search Report and Written Opinion, Application No. PCT/EP2012/059616, 8 pages, Jun. 28, 2012.

* cited by examiner

VALVE ASSEMBLY FOR AN INJECTION VALVE AND INJECTION VALVE

CROSS-REFERENCE TO RELATED APPLICATIONS

This application claims priority to EP Patent Application No. 11169988 filed Jun. 15, 2011. The contents of which is incorporated herein by reference in its entirety.

TECHNICAL FIELD

This disclosure relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. In particular, the injection valve may be suited to dose very small quantities of fluid under very high pressures. These pressures may be in case of a gasoline engine, for example, in the range of up to 200 bar and in the case of diesel engines in the range of more than 2000 bar.

SUMMARY

In one embodiment, a valve assembly for an injection valve comprises: a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, the valve needle comprising a protrusion extending in radial direction, and an electro-magnetic actuator unit being designed to actuate the valve needle, the electro-magnetic actuator unit comprising an armature axially movable in the cavity, wherein the armature comprises an armature cavity, the armature cavity having a first stop surface and a second stop surface, the normals of the stop surfaces being essentially orientated in axial direction, the second stop surface essentially facing the first stop surface, and the protrusion of the valve needle being arranged in the armature cavity axially between the first stop surface and the second stop surface in such a manner that a relative movement between the valve needle and the armature in axial direction is limited.

In a further embodiment, the armature comprises an armature main body and an armature retainer, the armature retainer being fixedly coupled to the armature main body and being shaped in a manner that the armature retainer and the armature main body form the armature cavity. In a further embodiment, the armature retainer is shaped as an annular collar. In a further embodiment, the longitudinal cross section of the armature retainer has a L-shape. In a further embodiment, a spring element is arranged in the armature cavity axially between the protrusion of the valve needle and the armature retainer. In a further embodiment, the spring element is a coil spring or a wave spring.

In another embodiment, an injection valve includes a valve assembly with any of the features disclosed above.

BRIEF DESCRIPTION OF THE DRAWINGS

Example embodiments will be explained in more detail below with reference to figures, in which.

DETAILED DESCRIPTION

Figure 1:
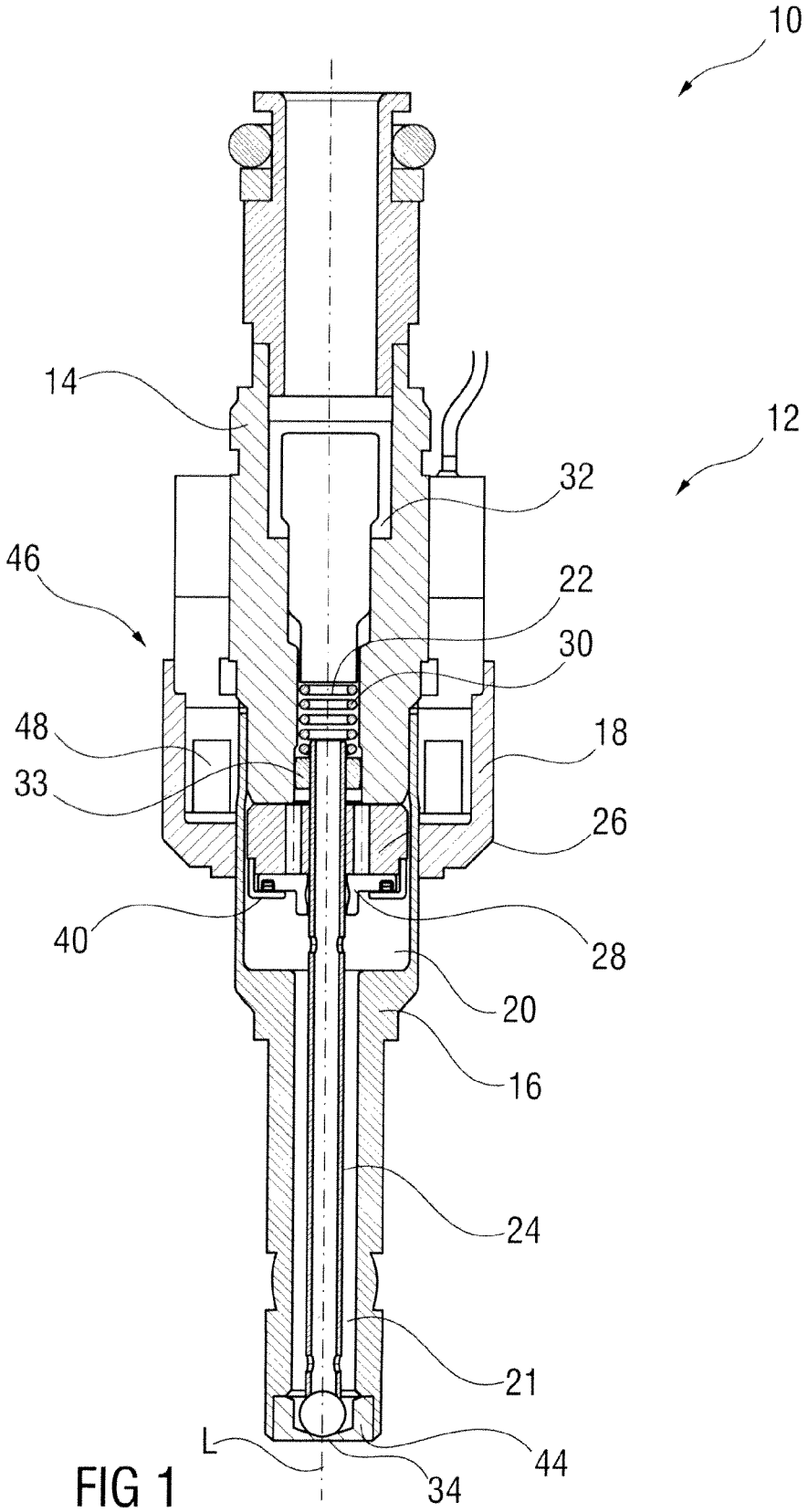
FIG. 1 illustrates an injection valve with a valve assembly in a longitudinal section view.

Some embodiments provide a valve assembly which facilitates a reliable and precise function.

For example, in some embodiments, a valve assembly for an injection valve includes a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, the valve needle comprising a protrusion extending in radial direction, and an electro-magnetic actuator unit being designed to actuate the valve needle. The electro-magnetic actuator unit comprises an armature axially movable in the cavity. The armature comprises an armature cavity. The armature cavity has a first stop surface and a second stop surface. The normals of the stop surfaces are essentially orientated in axial direction. The second stop surface essentially faces the first stop surface. The protrusion of the valve needle is arranged in the armature cavity axially between the first stop surface and the second stop surface in such a manner that a relative movement between the valve needle and the armature in axial direction is limited.

The arrangement of the protrusion of the valve needle in the armature cavity between the two stop surfaces may provide a clearly defined range of the relative position between the armature and the valve needle. Furthermore, a large contact surface between the armature retainer and the protrusion of the valve needle may be obtained. Consequently, the wearing between the protrusion of the valve needle and the armature can be kept small. Consequently, a stable performance of the operation of the injection valve may be obtained over a long time. Furthermore, a protective coating in a contact area between the armature retainer and the protrusion of the valve needle may be avoided.

In one embodiment the armature comprises an armature main body and an armature retainer. The armature retainer is fixedly coupled to the armature main body and is shaped in a manner that the armature retainer and the armature main body form the armature cavity. Such armature and armature cavity may be easily manufactured.

In a further embodiment the armature retainer is shaped as an annular collar. Such armature retainer may be easily manufactured. Furthermore, the armature cavity with the stop surfaces may have a well-defined shape.

In a further embodiment the longitudinal cross section of the armature retainer has an L-shape. Such armature retainer may be easily manufactured.

In a further embodiment a spring element is arranged in the armature cavity axially between the protrusion of the valve needle and the armature retainer. The armature may act on the valve needle via the spring element so that the movement of the valve needle may be delayed relative to the armature. By this the dynamic behavior of the valve needle may be dampened. Consequently, wearing effects on the valve needle and/or on the armature in the contact area between the valve needle and/or the armature may be kept small. Consequently, a good long term contact between the valve needle and the armature may be obtained and a static flow drift caused by the wearing effects may be kept small.

In a further embodiment the spring element is a coil spring or a wave spring. This may provide a simple shape of the spring element and a low cost solution. Furthermore, a secure arrangement of the spring element in the armature cavity may be obtained.

An injection valve 10 that is in particular suitable for dosing fuel to an internal combustion engine comprises in particular a valve assembly 12 and an inlet tube 14.

The valve assembly 12 comprises a valve body 16 with a central longitudinal axis L. The valve assembly 12 has a housing 18 which is partially arranged around the valve body 16.

A cavity 20 is arranged in the valve body 16. The cavity 20 comprises a fluid outlet portion 21 and a fluid inlet portion 22. The fluid outlet portion 21 is in hydraulic communication with the fluid inlet portion 22.

The cavity 20 takes in a valve needle 24 and an armature 26. The valve needle 24 is axially movable in the cavity 20. The valve needle 24 comprises a protrusion 28. The protrusion 28 may be formed as a collar around the valve needle 24. The protrusion 28 is fixedly coupled to the valve needle 24. The armature 26 is axially movable in the cavity 20.

A main spring 30 is arranged in a recess 32 which is provided in the inlet tube 14. The main spring 30 is mechanically coupled to a guide element 33. The guide element 33 is fixedly coupled to the valve needle 24. The main spring 30 exerts a force on the guide element 33 and, consequently, on the valve needle 24 towards an injection nozzle 34 of the injection valve 10. The injection nozzle 34 may be, for example, an injection hole.

The armature 26 has an armature cavity 36. The armature 26 has an armature main body 38 and an armature retainer 40. The armature retainer 40 is fixedly coupled to the armature main body 38. The armature main body 38 and the armature retainer 40 form the armature cavity 36. The armature retainer 40 may be shaped as a collar with an L-shaped longitudinal cross section.

The armature cavity 36 has a first stop surface 42*a* and a second stop surface 42*b*. The normal of the first stop surface 42*a* and the normal of the second stop surface 42*b* are orientated in an axial direction. The second stop surface 42*b* faces the first stop surface 42*a*. The protrusion 28 of the valve needle 24 is arranged in the armature cavity 36 axially between the first stop surface 42*a* and the second stop surface 42*b*. By this a relative movement between the valve needle 24 and the armature 26 in the axial direction is limited.

In a closing position of the valve needle 24 it sealingly rests on a seat plate 44 by this preventing a fluid flow through the at least one injection nozzle 34.

The valve assembly 12 is provided with an actuator unit 46 that may be an electro-magnetic actuator. The electro-magnetic actuator unit 46 comprises a coil 48, which may be arranged inside the housing 18. Furthermore, the electromagnetic actuator unit 46 comprises the armature main body 38. The valve body 16, the housing 18, the inlet tube 14 and the armature main body 38 are forming an electromagnetic circuit.

Figure 2:
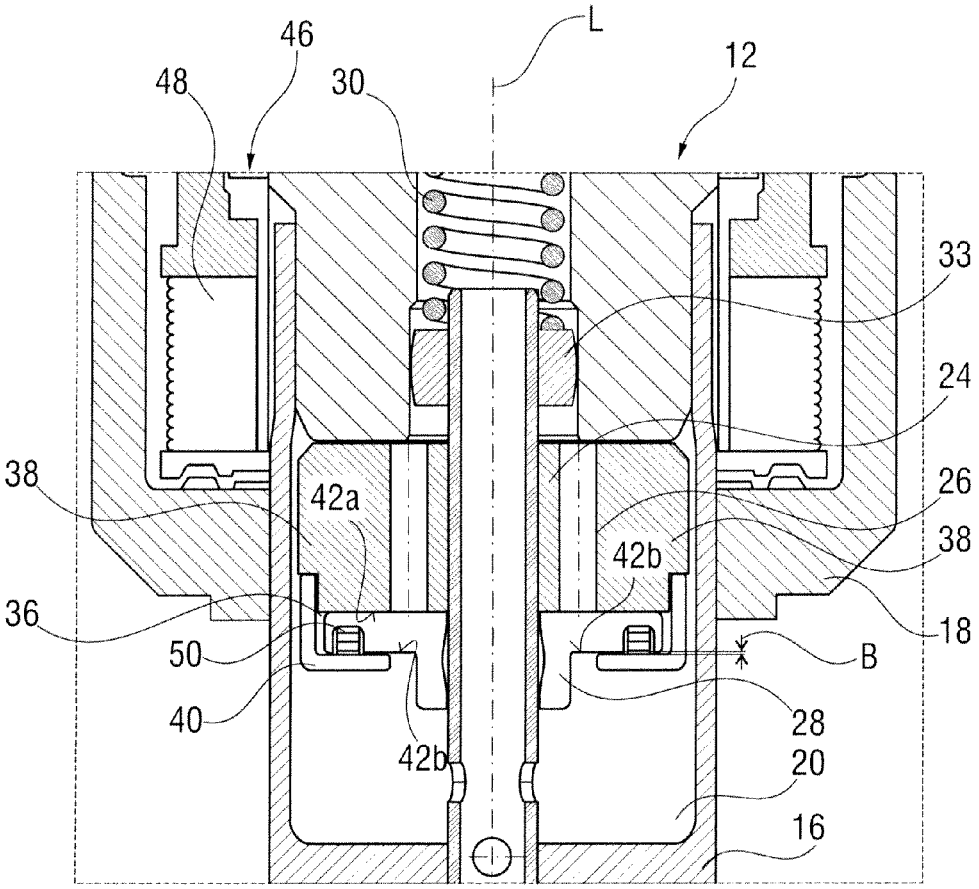
FIG. 2 illustrates an enlarged view of a part of the valve assembly.

A spring element 50 is arranged in the armature cavity 36 axially between the protrusion 28 of the valve needle 24 and the armature retainer 40 of the armature 26. The spring element 50 causes an axial basic distance (blind lift B, FIG. 2) between the protrusion 28 and the armature retainer 40 during a static condition of the valve assembly 12. The spring element 50 enables a dampened transmission of movements between the armature retainer 40 of the armature 26 and the protrusion 28 of the valve needle 24.

In the following, the function of the injection valve 10 is described in detail:

The fluid is led through the recess 32 of the fluid inlet tube 14 to the fluid inlet portion 22 in the valve body 16. Subsequently, the fluid is led towards the fluid outlet portion 21 in the valve body 16.

The valve needle 24 prevents a fluid flow through the fluid outlet portion 21 in the valve body 16 in a closing position of the valve needle 24. Outside of the closing position of the valve needle 24, the valve needle 24 enables the fluid flow through the fluid outlet portion 21.

In the case when the electro-magnetic actuator unit 46 with the coil 48 gets energized the actuator unit 46 may affect an electro-magnetic force on the armature 26. The armature 26 is attracted by the electro-magnetic actuator unit 46 with the coil 48 and moves in axial direction away from the fluid outlet portion 21. After the armature 26 has overcome the blind lift B between the armature 26 and the protrusion 28 of the valve needle 24 the armature 26 takes the valve needle 24 with it. Consequently, the valve needle 24 moves in axial direction out of the closing position. Outside of the closing position of the valve needle 24 the gap between the valve body 16 and the valve needle 24 at the axial end of the injection valve 10 facing away from of the actuator unit 46 forms a fluid path and fluid can pass through the injection nozzle 34.

In the case when the actuator unit 46 is de-energized the main spring 30 can force the valve needle 24 to move in axial direction in its closing position. It is depending on the force balance between the force on the valve needle 24 caused by the actuator unit 46 with the coil 48 and the force on the valve needle 24 caused by the main spring 30 whether the valve needle 24 is in its closing position or not.

The arrangement of the protrusion 28 of the valve needle 24 in the armature cavity 36 between the two stop surfaces 42*a*, 42*b* enables a limited range of relative positions between the armature 26 and the protrusion 28 of the valve needle 24. The valve needle 24 may float between the two stop surfaces 42*a*, 42*b* of the armature 26 in the range of the blind lift B to perform the opening and closing movement.

As a large contact surface between the armature retainer 40 and the protrusion 28 of the valve needle 24 can be obtained, the wearing between the protrusion 28 of the valve needle 24 and the armature 26 can be kept small. Consequently, a stable performance of the operation of the injection valve 10 can be obtained over a long term operating period of the injection valve 10. Furthermore, as the contact surface between the protrusion 28 of the valve needle 24 and the armature 26 may be so large that the contact pressure between the protrusion 28 of the valve needle 24 and the armature 26 can be kept small, a protective coating in the contact area between the armature retainer 40 and the protrusion 28 of the valve needle 24 may be avoided.

Additionally, as the protrusion 28 may be separate from the valve needle 24 and the armature retainer 40 may be separate from the armature 26, the protrusion 28 of the valve needle 24 and the armature retainer 40 need not be part of the magnetic circuit. Therefore, a simple hardening process can be carried out for the surfaces of the protrusion 28 of the valve needle 24 and the armature retainer 40 to keep the wearing of these two components small.

Additionally, an overshoot of the valve needle 24 and the armature 26 during the opening and the closing of the injection valve 10 can be kept small so that a very good dynamic control of the injection valve 10 can be obtained.

Furthermore, the guide element 33 is performing a guide function only without any additional task to perform the movement of the valve needle 24 during the opening or closing process.

Additionally, the armature 26 is decoupled from the valve needle 24 in a manner that the protrusion 28 allows the relative movement of the armature 26 relative to the valve needle 24. The protrusion 28 may limit the overshoot of the armature 26 as well as the overshoot of the valve needle 24.

Due to the spring element 50 a reliable transmission of the movement of the armature 26 to the valve needle 24 can be obtained. The dynamic behavior of the valve needle 24 is dampened. Therefore, the wearing effects on the armature 26 and/or the valve needle 24 in the contact area between the valve needle 24 and/or the armature 26 may be kept small during the opening or closing of the valve needle 24. Consequently, a good long term contact between the valve needle 24 and the armature 26 may be obtained.

What is claimed is:

1. Valve assembly for an injection valve, comprising:

a valve body including a central longitudinal axis, the valve body comprising a cavity with a fluid inlet portion and a fluid outlet portion, a valve needle axially movable in the cavity, the valve needle preventing a fluid flow through the fluid outlet portion in a closed position and releasing the fluid flow through the fluid outlet portion in further positions, the valve needle comprising a radially extending protrusion, and an electro-magnetic actuator unit being designed to actuate the valve needle, the electro-magnetic actuator unit comprising an armature axially movable in the cavity, wherein the armature comprises an armature cavity having a first stop surface and a second stop surface, wherein the second stop surface substantially faces the first stop surface, wherein the protrusion of the valve needle is arranged in the armature cavity axially between the first stop surface and the second stop surface such that a relative movement between the valve needle and the armature in axial direction is limited, wherein the armature comprises an armature main body and an armature retainer, the armature retainer being fixedly coupled to the armature main body and being shaped such that the armature retainer and the armature main body form the armature cavity, and wherein the valve assembly comprises a spring element arranged in the armature cavity axially between the protrusion of the valve needle and the armature retainer.

2. Valve assembly according to claim 1, wherein the armature retainer is shaped as an annular collar.

3. Valve assembly according to claim 1, wherein a longitudinal cross section of the armature retainer has a L- shape.

4. Valve assembly according to claim 1, wherein the spring element is a coil spring or a wave spring.

5. Valve assembly according to claim 1, wherein in a closed position of the valve needle, a spring force of the spring element maintains a gap between the protrusion of the valve needle and the second stop surface of the armature cavity.

6. Valve assembly according to claim 5, wherein in an open position of the valve needle, the spring force of the spring element is overcome such that the protrusion of the valve needle is moved into contact with the second stop surface of the armature cavity.

7. An injection valve for use in an internal combustion engine, comprising:

a valve assembly comprising:

a valve body including a central longitudinal axis, the valve body comprising a cavity with a fluid inlet portion and a fluid outlet portion, a valve needle axially movable in the cavity, the valve needle preventing a fluid flow through the fluid outlet portion in a closed position and releasing the fluid flow through the fluid outlet portion in further positions, the valve needle comprising a radially extending protrusion, and an electro-magnetic actuator unit being designed to actuate the valve needle, the electro-magnetic actuator unit comprising an armature axially movable in the cavity, wherein the armature comprises an armature cavity having a first stop surface and a second stop surface, wherein the second stop surface substantially faces the first stop surface, wherein the protrusion of the valve needle is arranged in the armature cavity axially between the first stop surface and the second stop surface such that a relative movement between the valve needle and the armature in axial direction is limited, wherein the armature comprises an armature main body and an armature retainer, the armature retainer being fixedly coupled to the armature main body and being shaped such that the armature retainer and the armature main body form the armature cavity, and wherein the valve assembly comprises a spring element arranged in the armature cavity axially between the protrusion of the valve needle and the armature retainer.

8. An injection valve according to claim 7, wherein the armature retainer is shaped as an annular collar.

9. An injection valve according to claim 7, wherein a longitudinal cross section of the armature retainer has a L-shape.

10. An injection valve according to claim 7, wherein the spring element is a coil spring or a wave spring.

11. An injection valve according to claim 7, wherein in a closed position of the valve needle, a spring force of the spring element maintains a gap between the protrusion of the valve needle and the second stop surface of the armature cavity.

12. An injection valve according to claim 11, wherein in an open position of the valve needle, the spring force of the spring element is overcome such that the protrusion of the valve needle is moved into contact with the second stop sur-face of the armature cavity.

13. A method of operation of an injection valve assembly comprising a valve body including a valve needle axially movable in a valve cavity between a closed position in which a fluid flow through a fluid outlet is prevented and an open position in which a fluid flow through a fluid outlet is allowed, the valve needle comprising a radially extending protrusion located axially between a first stop surface and a second stop surface of an armature cavity of an axially movable armature, with a spring element arranged in the armature cavity axially between the valve needle protrusion and the second stop surface of the armature cavity, the method comprising:

in a closed a closed position of the valve needle, the spring element maintains a gap between the valve needle protrusion and the second stop surface of the armature cavity, and activating an electro-magnetic actuator unit to move the armature relative to the valve needle in an axial direction such that the second stop surface of the armature cavity is moved across the gap and into contact with the valve needle protrusion, and further in the axial direction to carry the valve needle protrusion and valve needle from the closed position toward the open position.

* * * * *